US009982618B2

(12) United States Patent
Suzuki et al.

(10) Patent No.: US 9,982,618 B2
(45) Date of Patent: May 29, 2018

(54) CONTROL DEVICE FOR INTERNAL COMBUSTION ENGINE

(71) Applicant: TOYOTA JIDOSHA KABUSHIKI KAISHA, Toyota-shi, Aichi-ken (JP)

(72) Inventors: Takashi Suzuki, Miyoshi (JP); Tomoya Suzuki, Nagakute (JP); Keisuke Nagakura, Anjo (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 174 days.

(21) Appl. No.: 14/849,873

(22) Filed: Sep. 10, 2015

(65) Prior Publication Data

US 2016/0076475 A1 Mar. 17, 2016

(30) Foreign Application Priority Data

Sep. 12, 2014 (JP) ..... 2014-186542

(51) Int. Cl.
*F02D 41/22* (2006.01)
*F02D 41/30* (2006.01)
(Continued)

(52) U.S. Cl.
CPC ..... *F02D 41/222* (2013.01); *F02D 41/08* (2013.01); *F02D 41/3082* (2013.01);
(Continued)

(58) Field of Classification Search
CPC .... F02D 41/222; F02D 41/08; F02D 41/3082; F02D 2041/3881; F02D 41/061;
(Continued)

(56) References Cited

U.S. PATENT DOCUMENTS 8,562,303 B2 * 10/2013 Mori ..... F04B 49/06 123/497
2004/0005378 A1 * 1/2004 Uchiyama ..... B29C 45/7626 425/542

(Continued)

FOREIGN PATENT DOCUMENTS

JP 2009-174415 A 8/2009
JP 2013-068127 A 4/2013
JP 2013231362 A 11/2013

*Primary Examiner* — Hung Q Nguyen
*Assistant Examiner* — Brian P Monahon
(74) *Attorney, Agent, or Firm* — Hunton Andrews Kurth LLP

(57) ABSTRACT

An engine includes a low-pressure delivery pipe that stores fuel to be injected from port injection valves, a feed pump that supplies the fuel to the low-pressure delivery pipe, a high-pressure delivery pipe that stores the fuel to be injected from in-cylinder injection valves, a high-pressure pump driven in response to rotation of the engine, and a fuel pressure sensor that detects a pressure of the fuel stored in the low-pressure delivery pipe. An engine ECU controls the feed pump based on a detection value from a fuel pressure sensor, and when the engine ECU executes an abnormality diagnosis of the fuel pressure sensor, the engine ECU increases a rotational speed of the engine to be higher than a rotational speed when the engine ECU does not execute an abnormality diagnosis of the fuel pressure sensor. This improves the accuracy of an abnormality determination of the fuel pressure sensor.

5 Claims, 9 Drawing Sheets

(51) Int. Cl.
*F02D 41/08* (2006.01)
*F02D 41/06* (2006.01)
*F02D 41/38* (2006.01)
*F02M 63/02* (2006.01)

(52) U.S. Cl.
CPC ..... *F02M 63/0225* (2013.01); *F02D 41/061* (2013.01); *F02D 41/3094* (2013.01); *F02D 2041/223* (2013.01); *F02D 2041/227* (2013.01); *F02D 2041/3881* (2013.01); *F02D 2250/04* (2013.01); *F02D 2250/31* (2013.01)

(58) Field of Classification Search
CPC ..... F02D 2250/04; F02D 2041/227; F02D 2250/31; F02D 2041/223; F02D 41/3094; F02M 63/0225
See application file for complete search history.

(56) References Cited

U.S. PATENT DOCUMENTS

2007/0017483 A1* 1/2007 Tahara ..... F02D 41/221 123/431
2007/0079808 A1* 4/2007 Takahashi ..... F02D 41/221 123/447
2007/0277780 A1* 12/2007 Akazaki ..... F02D 35/028 123/406.22
2009/0093175 A1* 4/2009 Fujino ..... B63B 35/731 440/38
2009/0095061 A1* 4/2009 Fujino ..... B60R 16/0232 73/114.41
2009/0151469 A1* 6/2009 Suzuki ..... B60K 6/445 73/847
2010/0024768 A1* 2/2010 Ota ..... B60W 10/06 123/350
2011/0004390 A1* 1/2011 Nomura ..... F02C 9/28 701/100
2011/0097228 A1* 4/2011 Tokuo ..... F02M 37/0047 417/505
2011/0231083 A1* 9/2011 Saruwatari ..... F02D 41/22 701/107
2012/0017856 A1* 1/2012 Nicgorski ..... F01P 7/048 123/41.11
2012/0037119 A1* 2/2012 Adler ..... F02D 41/08 123/339.15
2013/0275026 A1* 10/2013 Methil-Sudhakaran ..... F02M 65/003 701/103
2014/0014065 A1* 1/2014 Hayashi ..... F02D 29/02 123/339.1
2014/0014809 A1* 1/2014 Okumura ..... F02B 77/085 248/610
2014/0018982 A1* 1/2014 O'Donnell ..... F02D 41/062 701/22

* cited by examiner

CONTROL DEVICE FOR INTERNAL COMBUSTION ENGINE

This nonprovisional application is based on Japanese Patent Application No. 2014-186542 filed on Sep. 12, 2014 with the Japan Patent Office, the entire contents of which are hereby incorporated by reference.

BACKGROUND OF THE INVENTION

Field of the Invention

This invention relates to a control device for an internal combustion engine, and particularly to a control device for an internal combustion engine including a port injection valve that injects fuel into an intake passage.

Description of the Background Art

Japanese Patent Laying-Open No. 2013-068127 discloses a control device to be applied to an internal combustion engine including a fuel pump and a fuel pressure sensor that detects a supply pressure of fuel to be supplied to a port injection valve from the fuel pump. The control device outputs an amount of operation of the fuel pump in accordance with a detection value from the fuel pressure sensor.

This control device changes, for a diagnosis of the fuel pressure sensor, the amount of operation of the fuel pump in a direction of increasing the supply pressure, and determines the presence or absence of a failure in the fuel pressure sensor based on the detection value from the fuel pressure sensor at that time.

A failure diagnosis of the fuel pressure sensor is performed as follows. The drive duty of the fuel pump is increased to a diagnostic duty to thereby increase the fuel pressure to a valve opening pressure of the relief valve. If the fuel pressure sensor at that time has not detected a pressure around the valve opening pressure, it is determined that the fuel pressure sensor is in an abnormal state.

The control device described in the above-described document performs an abnormality diagnosis for the fuel pressure sensor when there is an increase in deviation in air-fuel ratio. It is, however, desirable to detect an abnormality in the fuel pressure sensor before the deviation in air-fuel ratio due to the abnormality in the fuel pressure sensor actually continues.

Further, while the control device described in the above-described document checks whether the fuel pressure sensor detects a pressure around the valve opening pressure of the relief valve, it is more preferred to accurately check the performance of the fuel pressure sensor in further detail. For example, in order to check whether the detection value from the fuel pressure sensor changes, it is necessary to check detection values from the fuel pressure sensor at at least two pressure points. This failure detection to check whether the detection value from the fuel pressure sensor has not become a fixed value is referred to as the "stuck detection".

As described above, it is preferred to regularly perform a diagnosis of the fuel pressure sensor such as the stuck detection before the influence of an actual failure becomes serious. The present inventors, however, found as a result of experiments that a phenomenon in which the detection value from the fuel pressure sensor is unstable occurs depending on the rotational speed of the internal combustion engine, and this reduces the accuracy of an abnormality determination of the fuel pressure sensor at the time of an abnormality diagnosis of the fuel pressure sensor.

SUMMARY OF THE INVENTION

An object of this invention is to provide a control device for an internal combustion engine having improved accuracy of an abnormality determination of a fuel pressure sensor.

One aspect of this invention relates to a control device for an internal combustion engine. The internal combustion engine to be controlled includes a storage section that stores fuel to be injected into an intake passage, a feed pump that pressurizes and supplies the fuel to the storage section, a high-pressure storage section that stores the fuel to be injected into a cylinder, a high-pressure pump that is driven in response to rotation of the internal combustion engine, and pressurizes and supplies the fuel to the high-pressure storage section, and a fuel pressure sensor that detects a pressure of the fuel stored in the storage section. A pressure in the storage section is set to be lower than a pressure in the high-pressure storage section. The control device controls the feed pump based on a detection value from the fuel pressure sensor, and when the control device executes an abnormality diagnosis of the fuel pressure sensor, the control device increases a rotational speed of the internal combustion engine to be higher than a rotational speed when the control device does not execute an abnormality diagnosis of the fuel pressure sensor.

While a resonant frequency of the resonance phenomenon of the fuel pressure is determined by a dimension, the material, and the like of the fuel pipe system, the resonant frequency typically coincides with a frequency near an idle rotational speed of the engine. With the above-described configuration, an abnormality diagnosis of the fuel pressure is not performed, for example, near the idle rotational speed at which the resonance of pulsations in fuel pressure due to the high-pressure pump tends to occur. An abnormality diagnosis of the fuel pressure sensor is performed after the rotational speed is shifted to a rotational speed at which resonance is unlikely to occur. This improves the accuracy of the diagnosis.

Preferably, the control device determines a target rotational speed and a target torque of the internal combustion engine based on an operation line defined by torque and rotational speed, as well as power required for the internal combustion engine. When the control device does not execute an abnormality diagnosis of the fuel pressure sensor, the control device controls the internal combustion engine to achieve the target rotational speed and the target torque, and when the control device executes an abnormality diagnosis of the fuel pressure sensor, the control device controls the internal combustion engine such that the rotational speed thereof becomes higher than the target rotational speed.

By virtue of this control, during normal operation, fuel efficiency can be improved by determining the target rotational speed and the target torque to achieve optimal fuel efficiency, while during a diagnosis of the fuel pressure sensor in a very short period, such as the stuck detection or the like, the abnormality diagnosis can be executed accurately regardless of fuel efficiency.

More preferably, the feed pump is an electric pump that rotates based on a command from the control device, and the high-pressure pump is a mechanical pump configured to be driven by a cam that rotates in response to rotation of the internal combustion engine. The control device reduces a pulsation component due to operation of the high-pressure pump detected in the fuel pressure sensor, by increasing the rotational speed of the internal combustion engine to be higher than the target rotational speed.

Preferably, when the target rotational speed of the internal combustion engine falls within a predetermined resonant range, the control device increases the rotational speed of the internal combustion engine to fall outside the resonant range.

By virtue of this control, the resonance phenomenon does not occur during the diagnosis of the fuel pressure sensor. This improves the accuracy of the diagnosis.

According to another aspect of this invention, the internal combustion engine includes a storage section that stores fuel to be injected into an intake passage, a feed pump that pressurizes and supplies the fuel to the storage section, a high-pressure storage section that stores the fuel to be injected into a cylinder, a high-pressure pump that pressurizes and supplies the fuel to the high-pressure storage section, and a fuel pressure sensor that detects a pressure of the fuel stored in the storage section. A pressure in the storage section is set to be lower than a pressure in the high-pressure storage section. The control device controls the feed pump based on a detection value from the fuel pressure sensor, and when the control device executes an abnormality diagnosis of the fuel pressure sensor, the control device sets a target value of a pressure in the storage section to be higher than a pressure when the control device does not execute an abnormality diagnosis of the fuel pressure sensor.

When the target value of the pressure in the storage section is thus set to be high, the pressure generated by the feed pump is increased more than that during normal operation. Since a high fuel pressure reduces the amplitude of pulsations, the accuracy of the diagnosis is improved at the time of an abnormality diagnosis of the fuel pressure sensor.

Preferably, when the control device executes an abnormality diagnosis of the fuel pressure sensor, and when a target rotational speed of the internal combustion engine falls outside a predetermined resonant range, the control device sets the target value of the pressure in the storage section to a first value. When the control device executes an abnormality diagnosis of the fuel pressure sensor, and when the target rotational speed of the internal combustion engine falls within the predetermined resonant range, the control device sets the target value of the pressure in the storage section to a second value higher than the first value.

By virtue of this control, the fuel pressure is increased only where the resonance of the fuel pressure is likely to occur. This allows a decrease in energy loss caused by an unwanted increase in fuel pressure.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
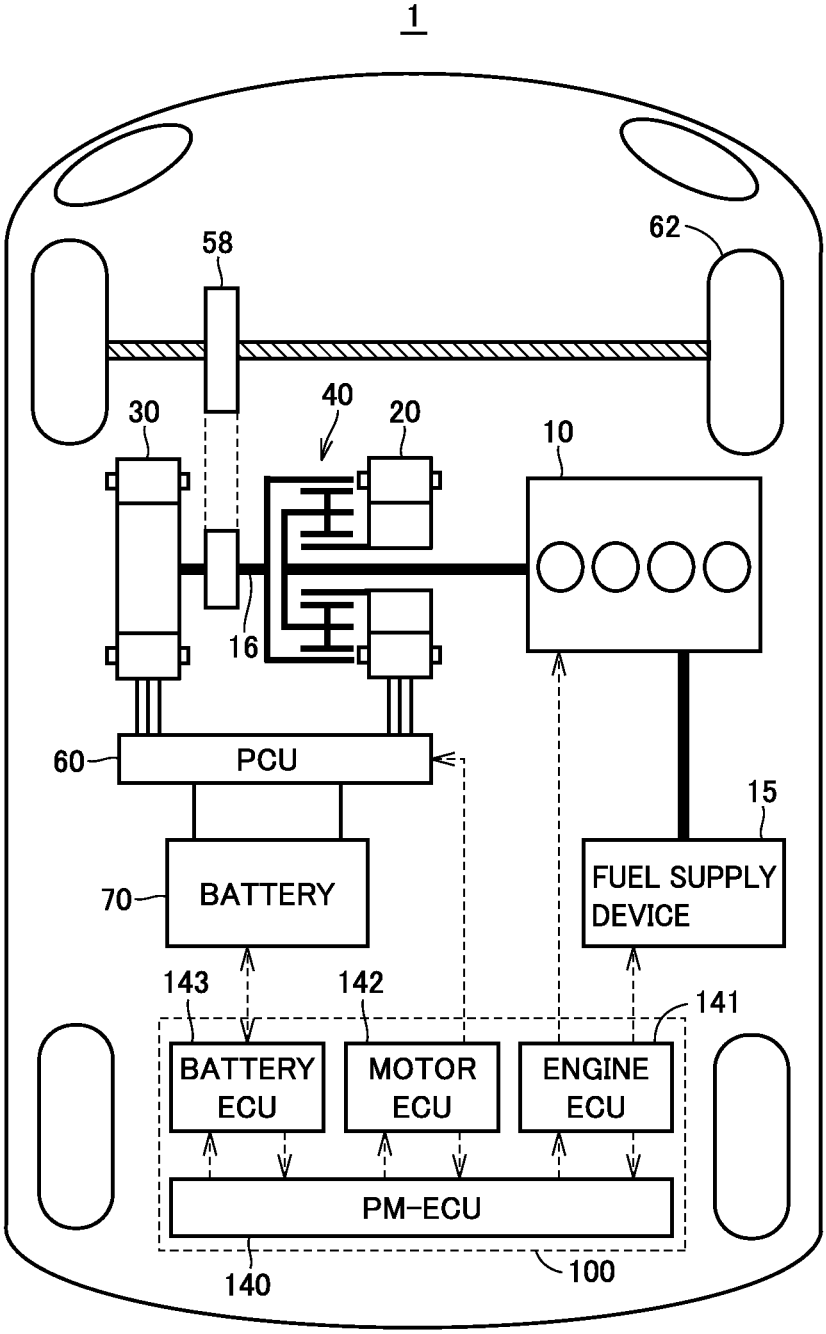
FIG. 1 is a block diagram showing the configuration of hybrid vehicle 1 to which the present invention is applied.

Embodiments of the present invention will be described below in detail with reference to the drawings, in which the same or corresponding elements are designated by the same reference characters, and the description thereof will not be repeated.

First Embodiment (Description of Basic Configuration)

FIG. 1 is a block diagram showing the configuration of a hybrid vehicle 1 to which the present invention is applied. Referring to FIG. 1, hybrid vehicle 1 includes engine 10, fuel supply device 15, motor generators 20 and 30, a power split device 40, a reduction mechanism 58, a driving wheel 62, a power control unit (PCU) 60, a battery 70, and a control device 100.

Engine 10, motor generator 20, and motor generator 30 are coupled to one another via power split device 40. Reduction mechanism 58 is connected to a rotation shaft 16 of motor generator 30, which is coupled to power split device 40. Rotation shaft 16 is coupled to driving wheel 62 via reduction mechanism 58, and is coupled to a crankshaft of engine 10 via power split device 40.

Power split device 40 is capable of splitting the driving force of engine 10 for motor generator 20 and rotation shaft 16. Motor generator 20 can function as a starter for starting engine 10 by rotating the crankshaft of engine 10 via power split device 40.

Motor generators 20 and 30 are both well-known synchronous generator motors that can operate both as power generators and electric motors.

Motor generators 20 and 30 are connected to PCU 60, which in turn is connected to battery 70.

Control device 100 includes an electronic control unit for power management (hereinafter referred to as "PM-ECU") 140, an electronic control unit for the engine (hereinafter referred to as "engine ECU") 141, an electronic control unit for the motors (hereinafter referred to as "motor ECU") 142, and an electronic control unit for the battery (hereinafter referred to as "battery ECU") 143.

PM-ECU 140 is connected to engine ECU 141, motor ECU 142, and battery ECU 143, via a communication port (not shown). PM-ECU 140 exchanges various control signals and data with engine ECU 141, motor ECU 142, and battery ECU 143.

Motor ECU 142 is connected to PCU 60 to control driving of motor generators 20 and 30. Battery ECU 143 calculates a remaining capacitance (hereinafter referred to as SOC (State of Charge)), based on an integrated value of charge/discharge current of battery 70.

Engine ECU 141 is connected to engine 10 and fuel supply device 15. Engine ECU 141 receives input of signals from various sensors that detect operation conditions of engine 10, and performs operation control such as fuel injection control, ignition control, intake air amount regulation control, and the like, in accordance with the input signals. Engine ECU 141 also controls fuel supply device 15 to supply fuel to engine 10.

The configuration and control of engine 10 and fuel supply device 15 in hybrid vehicle 1 having the above-described configuration will be described in more detail.

Figure 2:
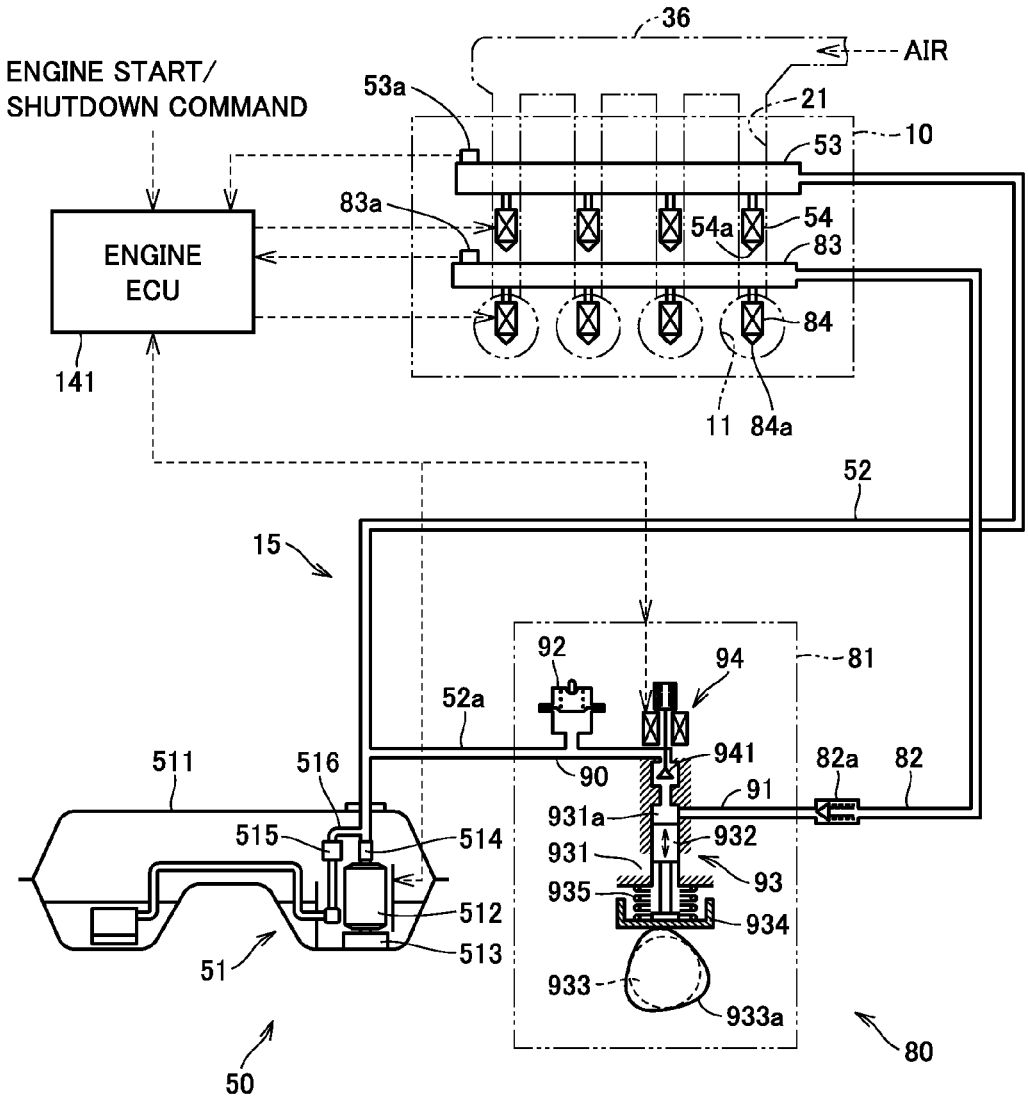
FIG. 2 is a diagram showing the configuration of engine 10 and fuel supply device 15 regarding fuel supply.

FIG. 2 is a diagram showing the configuration of engine 10 and fuel supply device 15 regarding fuel supply. In this embodiment, the vehicle to which the invention is applied is a hybrid vehicle that adopts, as an internal combustion engine, a dual injection-type internal combustion engine that uses both in-cylinder injection and port injection, for example, a serial four-cylinder gasoline engine.

Referring to FIG. 2, engine 10 includes an intake manifold 36, an intake port 21, and four cylinders 11 provided in a cylinder block.

When a piston (not shown) is lowered in each cylinder 11, intake air AIR flows into each cylinder 11 from an intake port pipe by way of intake manifold 36 and intake port 21.

Fuel supply device 15 includes a low-pressure fuel supply mechanism 50 and a high-pressure fuel supply mechanism 80. Low-pressure fuel supply mechanism 50 includes a fuel pumping section 51, a low-pressure fuel pipe 52, low-pressure delivery pipe 53, low fuel-pressure sensor 53*a*, and port injection valves 54. Low-pressure delivery pipe 53 corresponds to a "storage section" that stores fuel to be injected from port injection valves 54.

High-pressure fuel supply mechanism 80 includes a high-pressure pump 81, a check valve 82*a*, a high-pressure fuel pipe 82, a high-pressure delivery pipe 83, a high fuel-pressure sensor 83*a*, and in-cylinder injection valves 84. High-pressure delivery pipe 83 corresponds to a "high-pressure storage section" that stores fuel to be injected from in-cylinder injection valves 84.

Each in-cylinder injection valve 84 is an injector for in-cylinder injection having an injection nozzle hole 84*a* exposed within the combustion chamber of each cylinder 11. During a valve-opening operation of each in-cylinder injection valve 84, fuel pressurized within high-pressure delivery pipe 83 is injected into combustion chamber 16 from nozzle hole 84*a* of in-cylinder injection valve 84.

High-pressure pump 81 is connected between low-pressure fuel pipe 52 and high-pressure fuel pipe 82. Check valve 82*a* prevents backflow of the fuel from high-pressure fuel pipe 82 to high-pressure pump 81.

High-pressure pump 81 includes an upstream pipe 90, a downstream pipe 91, a pulsation damper 92, a high-pressure pump body 93, and an electromagnetic spill valve 94. Upstream pipe 90 of high-pressure pump 81 is connected to a low-pressure fuel pipe 52*a* branched from low-pressure fuel pipe 52, while downstream pipe 91 is connected to high-pressure fuel pipe 82.

Pulsation damper 92, which is provided along upstream pipe 90, has an elastic diaphragm that receives a fuel pressure and a compression coil spring. Pulsation damper 92 is configured to undergo a change in internal volume due to an elastic deformation of the diaphragm, and suppress pressure pulsations in the fuel within upstream pipe 90.

In high-pressure pump body 93, a pressurizing chamber 931*a* undergoes a change in volume due to reciprocating motion of a plunger 932. When opened, electromagnetic spill valve 94 permits the fuel to be drawn into pressurizing chamber 931*a* in response to a displacement of plunger 932, and the fuel within pressurizing chamber 931*a* to be delivered to low-pressure fuel pipe 52. When closed, electromagnetic spill valve 94 functions as a check valve.

A follower lifter 934 is pressed by a cam 933*a*, thereby causing plunger 932 to slide. A return spring 935, which includes a compression coil spring provided between a pump housing 931 and follower lifter 934, biases follower lifter 934 against cam 933*a*.

A cam shaft 933 is provided on one end of the exhaust cam shaft of engine 10, and has cam 933*a* on an end. While engine 10 is being driven, cam shaft 933 is constantly rotating, which causes high-pressure pump body 93 to operate in conjunction with engine 10 being driven.

High-pressure delivery pipe 83 is connected to high-pressure fuel pipe 82 on one end thereof in a direction of the serial arrangement of cylinders 11. In-cylinder injection valves 84 are connected to high-pressure delivery pipe 83. High-pressure delivery pipe 83 is equipped with high fuel-pressure sensor 83*a* that detects an internal fuel pressure.

Engine ECU 141 is configured to include a CPU (Central Processing Unit), a ROM (Read Only Memory), a RAM (Random Access Memory), an input interface circuit, an output interface circuit, and the like. Engine ECU 141 controls engine 10 and fuel supply device 15 in response to an engine start/shutdown command from PM-ECU shown in FIG. 1.

Engine ECU 141 calculates a fuel injection amount required for every combustion cycle based on the accelerator pedal position, the intake air amount, the engine rotational speed, and the like. Engine ECU 141 also outputs an injection command signal or the like to each port injection valve 54 and each in-cylinder injection valve 84, at an appropriate time, based on the fuel injection amount calculated.

At the start of engine 10, engine ECU 141 causes port injection valves 54 to perform fuel injection first. ECU 140 then begins to output an injection command signal to each in-cylinder injection valve 84 when the fuel pressure within high-pressure delivery pipe 83 detected by high fuel-pressure sensor 83*a* has exceeded a preset pressure value.

Furthermore, while engine ECU 141 basically uses in-cylinder injection from in-cylinder injection valves 84, for example, it also uses port injection under a specific operation state in which in-cylinder injection does not allow sufficient formation of an air-fuel mixture, for example, during the start and the warm-up of engine 10, or during rotation of engine 10 at low speed and high load. Alternatively, while engine ECU 141 basically uses in-cylinder injection from in-cylinder injection valves 84, for example, it also causes port injection from port injection valves 54 to be performed when port injection is effective, for example, during rotation of engine 10 at high speed and low load.

In this embodiment, fuel supply device 15 has a feature in that the pressure of low-pressure fuel supply mechanism 50 is variably controllable. Low-pressure fuel supply mechanism 50 of fuel supply device 15 will be described below in more detail.

Fuel pumping section 51 includes a fuel tank 511, a feed pump 512, a suction filter 513, a fuel filter 514, a relief valve 515, and a fuel pipe 516 connecting these components.

Fuel tank 511 stores a fuel consumed by engine 10, for example, gasoline. Suction filter 513 prevents suction of foreign matter. Fuel filter 514 removes foreign matter contained in discharged fuel.

Relief valve 515 opens when the pressure of the fuel discharged from feed pump 512 reaches an upper limit pressure, and remains closed while the pressure of the fuel is below the upper limit pressure.

Low-pressure fuel pipe 52 connects from fuel pumping section 51 to low-pressure delivery pipe 53. Note, however, that low-pressure fuel pipe 52 is not limited to a fuel pipe, and may also be a single member through which a fuel passage is formed, or may be a plurality of members having a fuel passage formed therebetween.

Low-pressure delivery pipe 53 is connected to low-pressure fuel pipe 52 on one end thereof in a direction of the serial arrangement of cylinders 11. Port injection valves 54 are connected to low-pressure delivery pipe 53. Low-pressure delivery pipe 53 is equipped with low fuel-pressure sensor 53*a* that detects an internal fuel pressure.

Each port injection valve 54 is an injector for port injection having an injection nozzle hole 54*a* exposed within intake port 21 corresponding to each cylinder 11. During a valve-opening operation of each port injection valve 54, fuel pressurized within low-pressure delivery pipe 53 is injected into intake port 21 from nozzle hole 54*a* of port injection valve 54.

Feed pump 512 is driven or stopped in accordance with a command signal sent from engine ECU 141.

Feed pump 512 is capable of pumping up fuel from fuel tank 511, and discharging the fuel pressurized to a pressure in a certain variable range of less than 1 [MPa: megapascal], for example. Feed pump 512 is also capable of changing the amount of discharge [$m^3$/sec] and the discharge pressure [kPa: kilopascal] per unit time, under the control of engine ECU 141.

This control of feed pump 512 is preferable in the following respects. Firstly, in order to prevent gasification of the fuel inside low-pressure delivery pipe 53 when the engine is heated to a high temperature, it is necessary to exert a pressure on low-pressure delivery pipe 53 beforehand such that the fuel does not gasify. An excessive pressure, however, will cause a great load on the pump, leading to a large energy loss. Since the pressure for preventing gasification of the fuel changes depending on the temperature, energy loss can be reduced by exerting a required pressure on low-pressure delivery pipe 53. Secondly, wasteful consumption of energy for pressurizing the fuel can be reduced by controlling feed pump 512 appropriately to deliver an amount of fuel corresponding to an amount of fuel consumed by the engine. This is advantageous in that the fuel efficiency is improved over a configuration in which the fuel is excessively pressurized, and then the fuel pressure is adjusted to be constant with a pressure regulator.

In order to perform variable fuel-pressure control with feed pump 512, it is necessary to ensure reliability of a detection value from low fuel-pressure sensor 53*a* provided on low-pressure delivery pipe 53 that stores fuel for port injection. Thus, the stuck detection of the detection value from low fuel-pressure sensor 53*a* is regularly performed.

(Explanation of Basic Processing of Stuck Detection Control)

The stuck detection is a failure detection to check whether the detection value from low fuel-pressure sensor 53*a* has not become a fixed value. In order to check whether the detection value from low fuel-pressure sensor 53*a* changes, it is necessary to check detection values from low fuel-pressure sensor 53*a* at at least two pressures.

This stuck detection is preferably performed beforehand at an early stage before, for example, the state in which there is a deviation in air-fuel ratio as a result of a failure in low fuel-pressure sensor 53*a* continues.

In one example, the stuck detection is performed as shown in the waveform in FIG. 3 to be described next. Specifically, after engine start, the fuel pressure is increased to be higher than a fuel pressure during normal use, and then the fuel pressure is reduced. Then, the stuck detection is performed.

Figure 3:
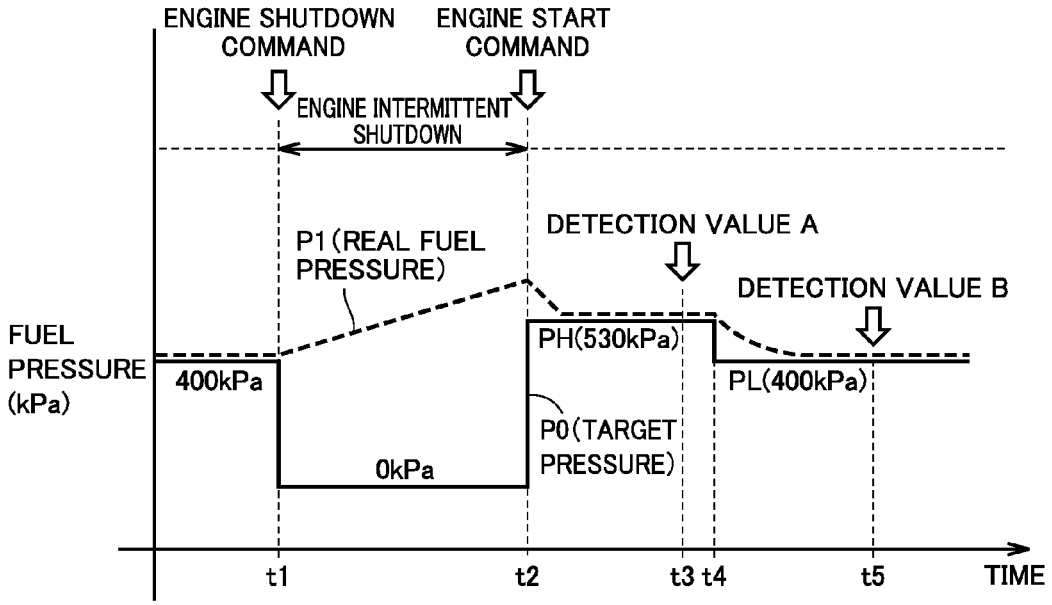
FIG. 3 is a waveform diagram showing one example of a change in fuel pressure when stuck detection processing is performed.

FIG. 3 is a waveform diagram showing one example of a change in fuel pressure when the stuck detection processing is performed.

Referring to FIG. 3, at time t1, if engine 10 is in operation, an engine stop command is output from PM-ECU 140, in response to which engine ECU 141 causes the engine to stop.

Then, at time t2, an engine start command is output from PM-ECU 140, in response to which engine ECU 141 causes the operation of the engine to begin, and causes target pressure P0 of fuel pressure to change in the sequence described below, in order to perform the stuck detection.

First, between times t2 and t3, engine ECU 141 performs processing to set the target fuel pressure to be high (530 [kPa]) and obtain a detection value A. Engine ECU 141 then reduces the target fuel pressure, and performs between times t4 and t5 processing to set the target fuel pressure to be low (400 [kPa]) and obtain a detection value B.

It is noted that although target fuel pressure P0 is set to 0 [kPa] between times t1 and t2, the real fuel pressure does not obey target fuel pressure P0 indicated by the solid line. This is because once the engine stops, the fuel is no longer injected from the port injection valves, and thus, the fuel pressure in the low-pressure delivery pipe cannot be reduced. Moreover, expansion of the fuel being sealed in the low-pressure delivery pipe due to heat from the engine may cause the fuel pressure to increase as shown by real fuel pressure P1 indicated by the broken line in FIG. 3.

In this case, if the stuck detection is to be performed by changing the target fuel pressure from a low pressure to a high pressure, the fuel pressure must be reduced once to perform the stuck detection. For this reason, where real fuel pressure P1 [kPa] is higher than 530 [kPa], as shown at time t2 in FIG. 3, it is preferred to start with the processing to set the target value of fuel pressure to 530 [kPa]. This allows the stuck detection to begin at an earlier stage than the case where the processing to set the target value of fuel pressure to 400 [kPa] is performed first, by an amount of time required for the fuel pressure to decrease from 530 [kPa] to 400 [kPa].

Figure 4:
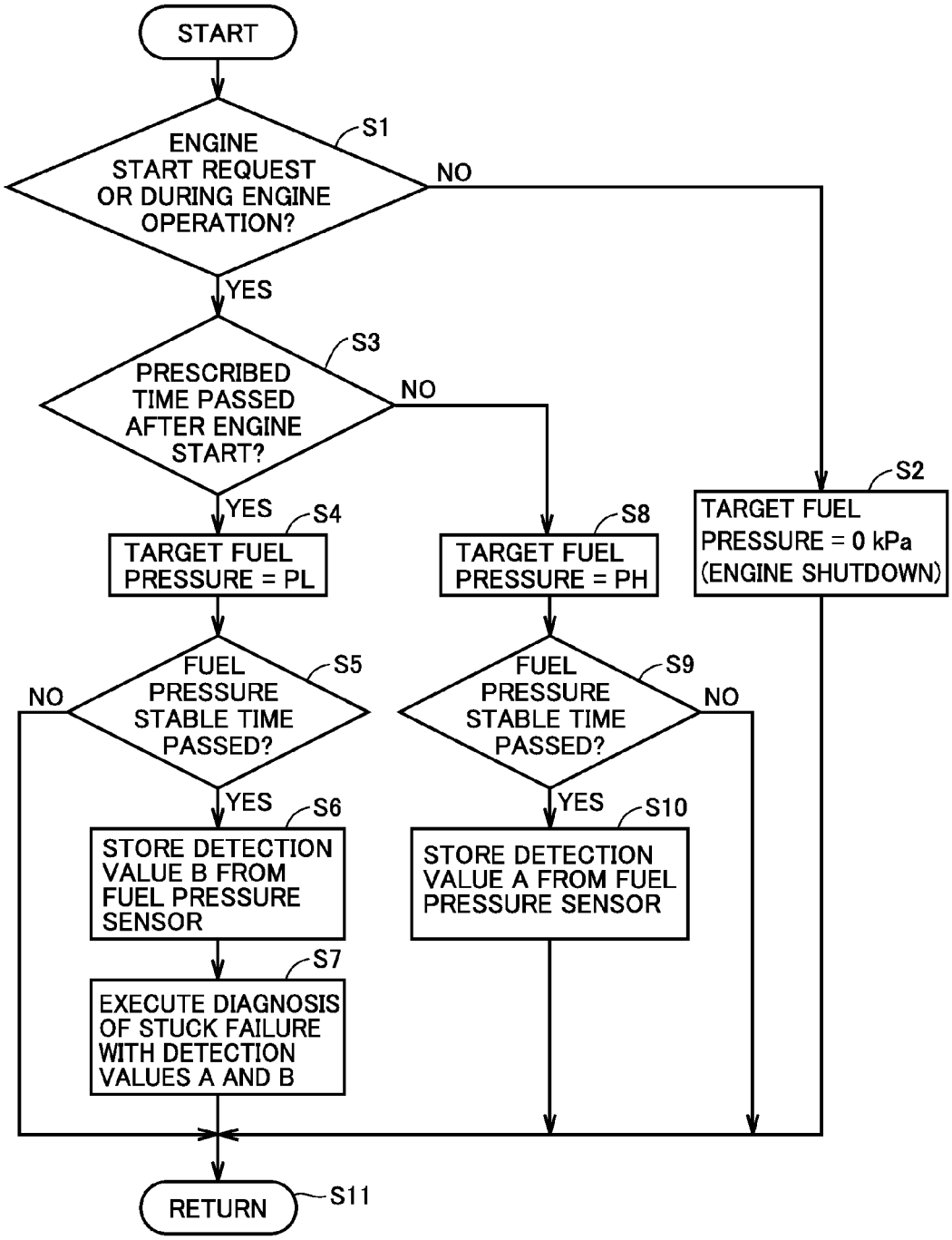
FIG. 4 is a flowchart for explaining basic processing during the stuck detection of low fuel-pressure sensor 53*a;*

FIG. 4 is a flowchart for explaining basic processing during stuck detection of low fuel-pressure sensor 53*a*. The flowchart shown in FIG. 4 is executed by being invoked from a main routine at every constant period or every time a predetermined condition is established.

With reference to FIGS. 3 and 4, in step S1, if there is no engine start request, and the engine is not in operation (NO in S1), the processing proceeds to step S2. As a result, the target fuel pressure of low-pressure delivery pipe 53 is set to 0 [kPa] between times t1 and t2.

On the other hand, if there is an engine start request, or the engine is in operation (YES in S1), the processing proceeds to step S3. In step S3, it is determined whether or not a predetermined time has passed after the start of the engine.

As a result, between times t2 and t4 before the predetermined time passes, the target fuel pressure is set to PH (530 [kPa], for example) in step S8. PH represents a diagnostic fuel pressure set to be higher than a normally used fuel pressure, for the stuck detection of the fuel pressure sensor. Then, at t3 where the time during which the fuel pressure is stable has passed, fuel pressure sensor detection value A is stored (steps S9 and S10).

Between times t4 and t5 after the predetermined time has passed, the target fuel pressure is set to PL (400 [kPa], for example) in step S4. PL represents a fuel pressure lower than PH. Note that target fuel pressure PL may not be equal to a fuel pressure during normal operation, so long as it is set to be lower than target fuel pressure PH for diagnosis set in step S8. Then, at t5 where the time during which the fuel is stable has passed, fuel pressure sensor detection value B is stored (steps S5 and S6).

With both detection values A and B, a diagnosis of the presence or absence of a stuck failure is executed in step S7. Where detection value A shows a value near PH (530 [kPa], for example) and detection value B shows a value near PL (400 [kPa], for example), low fuel-pressure sensor 53*a* is determined to be normal. If detection values A and B are equal, engine ECU 141 determines that low fuel-pressure sensor 53*a* has a stuck failure.

After the completion of the diagnosis of a stuck failure in step S7, the processing proceeds to step S11 where the control is returned to the main routine.

(Deterioration Phenomenon of Detection Value from Fuel Pressure Sensor during Stuck Detection)

During the stuck detection as described above, the accuracy of the detection value from the fuel pressure sensor may deteriorate when the rotational speed of the engine is within a certain range. This phenomenon is preferably avoided since it may cause an incorrect determination in the stuck detection. A cause of the deterioration of the accuracy of the detection value from the fuel pressure sensor will be described below.

Figure 5:
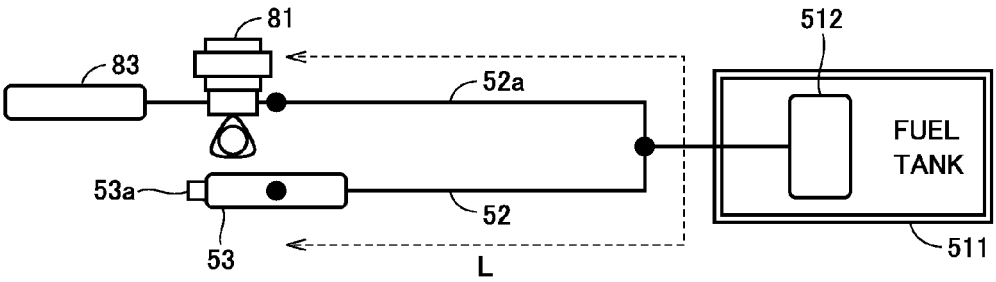
FIG. 5 is a schematic diagram showing a path leading from a fuel tank to a high-pressure delivery pipe and a low-pressure delivery pipe.

FIG. 5 is a schematic diagram showing a path leading from the fuel tank to the high-pressure delivery pipe and the low-pressure delivery pipe. With reference to FIG. 5, low-pressure fuel pipe 52 extends toward low-pressure delivery pipe 53, and low-pressure fuel pipe 52*a* extends toward high-pressure delivery pipe 83, from feed pump 512 in fuel tank 511. High-pressure pump 81 is provided at one end of low-pressure fuel pipe 52*a* near high-pressure delivery pipe 83.

Feed pump 512 is an electric pump that is driven by an electric motor controlled by engine ECU 141, and can change the fuel pressure. High-pressure pump 81, on the other hand, is a mechanical pump that is driven in response to the rotation of the engine.

High-pressure pump 81 sucks the fuel from low-pressure fuel pipe 52*a*, pressurizes the fuel, and delivers the pressurized fuel to high-pressure delivery pipe 83. The present inventors experimentally found that pulsations in fuel pressure due to this operation of high-pressure pump 81 are a cause of deterioration of the accuracy of the detection value from the fuel pressure sensor.

Pulsations in fuel pressure due to the rotation of a cam occur at a suction-side connected end of high-pressure pump 81 of low-pressure fuel pipe 52*a*. Suction of the fuel by plunger 932 in high-pressure pump 81 is the vibration source of these pulsations.

Figure 6:
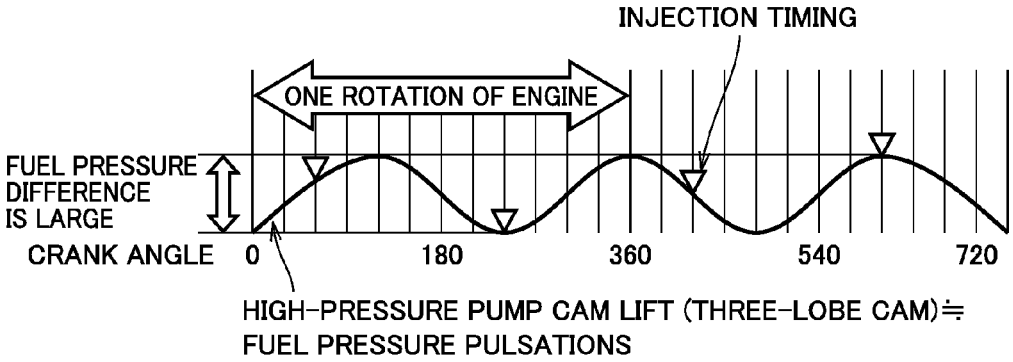
FIG. 6 is a diagram for explaining the rotation of a cam and a vibration source of pulsations in fuel pressure in the low-pressure delivery pipe.

FIG. 6 is a diagram for explaining the rotation of the cam and the vibration source of pulsations in fuel pressure in the low-pressure delivery pipe. In FIG. 6, the horizontal axis represents crank angle, and the vertical axis represents fuel pressure. In the case of a four-cylinder engine, there is one injection timing for each cylinder in the range of crank angles of 720 degrees. In the case of a four-stroke one-cycle engine, the cam shaft makes one rotation for two rotations of the crankshaft of the engine. Cam 933*a* has three lobes as shown in FIG. 2, and as a result, the amount of lift by cam 933*a* changes as shown in FIG. 6.

A resonance phenomenon that occurs in the low-pressure fuel pipe system will now be described. As with the resonance in the air-column, a natural resonant frequency of the resonance in the low fuel-pressure pipe system is determined by a dimension such as a total pipe length L of low-pressure fuel pipes 52 and 52*a* shown in FIG. 5, and the material of the pipes (metal, resin, or the like). When the pulsation frequency of fuel pressure coincides with this resonant frequency, an increased pulsation component is superimposed on the fuel pressure detected by low-pressure fuel sensor 53*a*.

The frequency of pulsations at which the resonance phenomenon occurs in the low pressure fuel system of the engine correspond to an engine rotational speed within a certain limited range. The range of these engine rotational speeds will be referred to as the "resonant range". While the frequency of pulsations changes with the rotational speed of the cam, the rotational speed of the cam is proportional to the rotational speed of the engine. After all, when a multiple of the rotational speed of the engine coincides with the resonant frequency of the low-pressure fuel pipe system, noticeable fluctuations in fuel pressure due to the pulsation component occur. When, therefore, the resonance phenomenon occurs in the low fuel-pressure pipe system, these increased pulsations may be detected at low-pressure fuel sensor 53*a*.

(Processing to Improve Accuracy of Detection Value from Fuel Pressure Sensor during Stuck Detection)

As explained with FIG. 5, when the resonance phenomenon occurs, low-pressure delivery pipe 53 is significantly affected by the pulsations in fuel pressure due to a change in the amount of lift by the cam in high pressure pump 81. Although the pulsations in fuel pressure can be damped to some extent by pulsation damper 92 shown in FIG. 2, they are not completely eliminated. If noticeable pulsations in fuel pressure occur during an abnormality diagnosis of low-pressure fuel sensor 53*a*, the detection value from the fuel pressure sensor will fluctuate, which may cause the accuracy of the abnormality diagnosis to deteriorate.

In the first embodiment, therefore, in order to reduce pulsations in fuel pressure in low-pressure delivery pipe 53 during checking of low-pressure fuel sensor 53*a*, the rotational speed of the engine is shifted to suppress the occurrence of resonance, so as to avoid the "resonant range" determined from the pipe system. This allows a decrease in the magnitude of pulsations in fuel pressure, leading to improvement in the accuracy of the abnormality diagnosis of low-pressure fuel sensor 53*a*.

Figure 7:
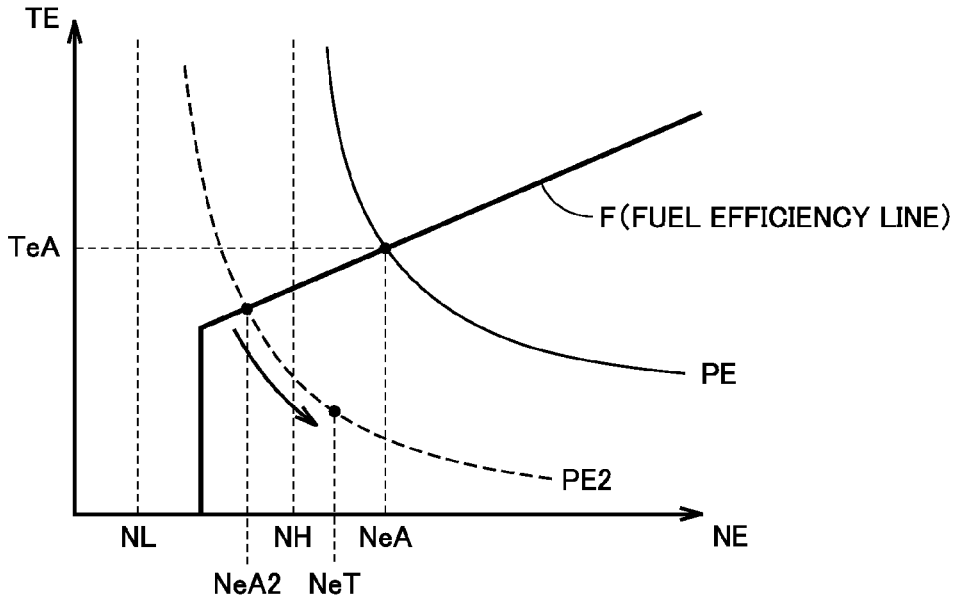
FIG. 7 is a diagram for explaining control of engine rotational speed in a first embodiment.

FIG. 7 is a diagram for explaining control of engine rotational speed in the first embodiment. In the hybrid vehicle shown in FIG. 1, the gear ratios can be continuously varied using motor generators 20, 30 and power split device 40. It is thus possible to set the engine rotational speed with respect to the vehicle speed relatively freely.

Fuel efficiency line F shown in FIG. 7 is an operation line that connects operating points at which engine 10 can operate most efficiently (namely, with optimal fuel efficiency), using an engine rotational speed NE and an engine torque TE as parameters. When the horizontal axis represents engine rotational speed NE and the vertical axis represents engine torque TE, fuel efficiency line F is as shown in FIG. 7. On the other hand, since engine power PE is a product of engine rotational speed NE and engine torque TE (PE=NE×TE), a line representing operating points of the engine at which constant PE is output is shown as an inversely proportional curve as shown in FIG. 7.

Control device 100 calculates an optimal fuel efficiency rotational speed NeA and an optimal fuel efficiency torque TeA, from an intersection of optimal fuel efficiency line F and line PE representing an equal power line. Engine 10 can output engine required power PE most efficiency when optimal fuel efficiency rotational speed NeA and optimal fuel efficiency torque TeA thus calculated are set as a target engine operating point, and the ignition timing, the amount of fuel injection, and the like are controlled to achieve them.

Now, the case where an abnormality diagnosis of low-pressure fuel sensor 53*a* is executed during idling of the engine immediately after being started will be considered. During idling of the engine immediately after being started, the engine required power is low, as represented by line PE2 shown by the broken line in FIG. 7. Thus, an engine rotational speed NeA2 is determined from an intersection of optimal fuel efficiency line F and line PE2. Rotation speed NeA2, however, is within a rotational speed range NL-NH where pulsations in fuel pressure in low-pressure delivery pipe 53 are increased by the resonance phenomenon. If an abnormality diagnosis of low-pressure fuel sensor 53*a* is executed in this state, the detection value will be affected by the increased pulsations in fuel pressure due to the resonance phenomenon. As a result, the accuracy of the abnormality diagnosis will deteriorate.

Thus, when a diagnosis of low-pressure fuel sensor 53*a* is performed, the engine is controlled with the target value set to an engine rotational speed NeT shifted to a higher speed outside rotational speed range NL-NH, so as to avoid the resonance phenomenon. As a result, the influence of pulsations in fuel pressure on the detection value from low-pressure fuel sensor 53*a* can be reduced.

Figure 8:
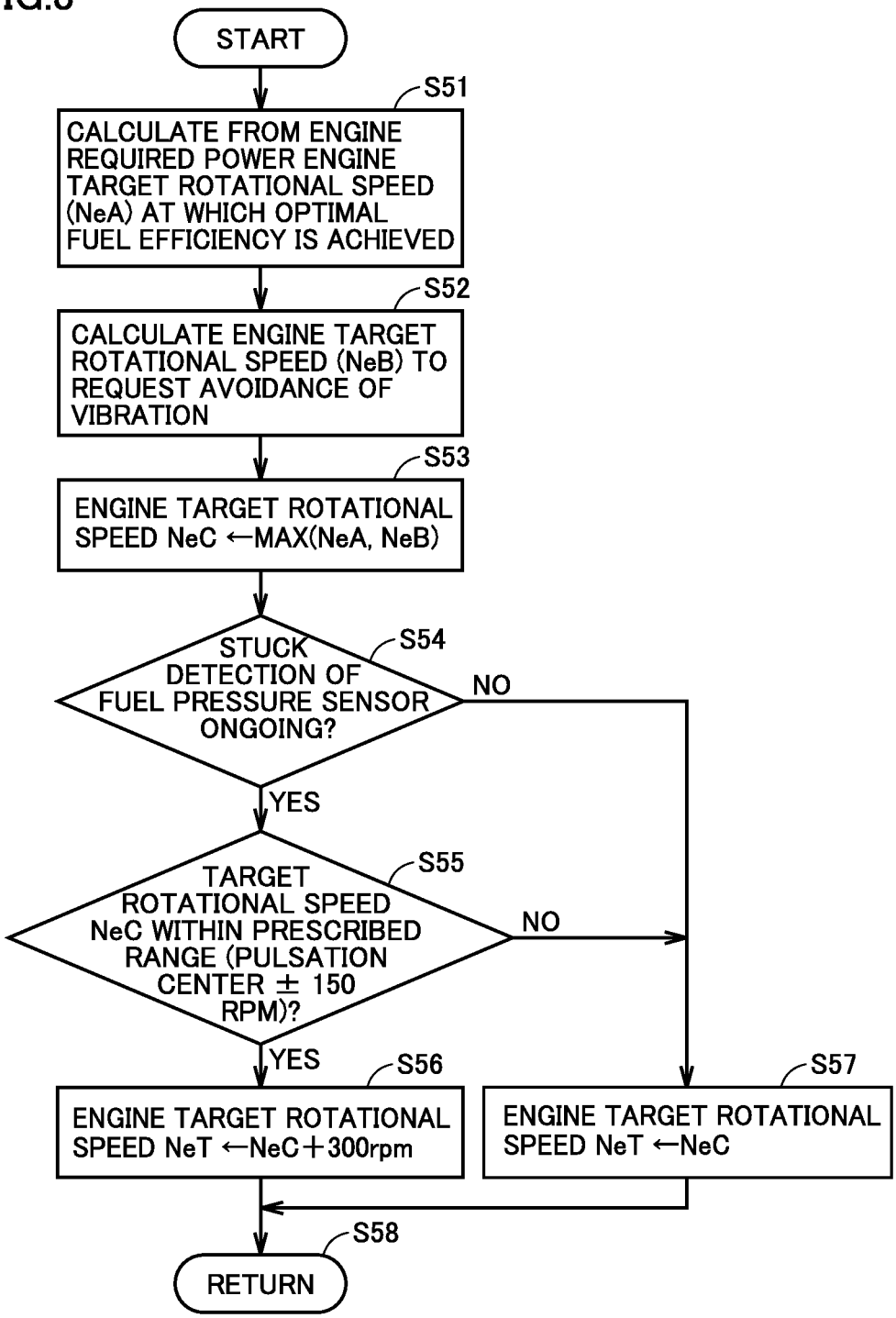
FIG. 8 is a flowchart for explaining processing for determining an engine target rotational speed executed in the first embodiment.

FIG. 8 is a flowchart for explaining processing for determining an engine target rotational speed executed in the first embodiment. With reference to FIG. 8, first in step S51, control device 100 calculates from the engine required power an engine target rotational speed NeA at which optimal fuel efficiency is achieved. In this case, target rotational speed NeA is determined from an intersection of the equal power line and the optimal fuel efficiency line shown in FIG. 7.

Then in step S52, an engine target rotational speed NeB for avoiding vibration of the vehicle is calculated. This engine target rotational speed NeB is a value related to the resonant frequency determined for each vehicle, depending on the rigidity of the entire vehicle, the arrangement of parts, the rigidity of the suspension, and the like.

Then in step S53, the maximal value of engine target rotational speeds NeA and NeB is determined as an engine target rotational speed NeC.

Next, in step S54, it is determined whether the stuck detection of low-pressure fuel sensor 53*a* is ongoing or not. As explained with FIGS. 3 and 4, the stuck detection refers to the processing to check the detection value from low-pressure fuel sensor 53*a* by changing the target fuel pressure.

Where the stuck detection of the fuel pressure sensor is ongoing in step S54 (YES in S54), the processing proceeds to step S55. In step S55, it is determined whether engine target rotational speed NeC is within a prescribed range (within the resonant range) or not. The prescribed range is, for example, the range of rotational speeds of ±150 rpm from an engine rotational speed corresponding to a natural frequency of the fuel pipe system (this engine rotational speed will be referred to as the "pulsation center" herein).

Where it is determined in step S55 that target rotational speed NeC is within the prescribed range (YES in S55), the processing proceeds to step S56 where the processing to shift target rotational speed NeT outside the prescribed range is performed. Where the prescribed range is pulsation center ±150 rpm, for example, engine target rotational speed NeT may be shifted by 300 rpm corresponding to the width of the prescribed range, so that engine target rotational speed NeT falls outside the prescribed range. This prevents an increase in pulsations in fuel pressure in low-pressure delivery pipe 53, which stabilizes the detection value from low-pressure fuel sensor 53*a*, leading to improvement in the diagnosis of a stuck failure of low-pressure fuel sensor 53*a*.

It is noted that in the case of NO in steps S54 and S55, the processing proceeds to step S57 where NeC is directly used as engine target rotational speed NeT.

Once engine target rotational speed NeT is determined in step S56 or S57, the control is returned to the main routine in step S58. Thereafter, the engine is controlled to be rotational speed NeT.

As described above, in the first embodiment, when an actual fuel pressure is measured by the fuel pressure sensor with the target fuel pressure determined for an abnormality diagnosis of the fuel pressure sensor, the rotational speed of the engine is shifted to avoid the predetermined range (resonant range: NL-NH in FIG. 7) determined from the fuel pressure pipe system. In particular, during engine start, generally, the rotational speed during the idle operation (which will be referred to as the "idle rotational speed") is set as the target rotational speed. However, since the idle rotational speed is near the rotational speed at which resonance occurs, the engine is operated at a rotational speed higher than the idle rotational speed during a diagnosis of the fuel pressure sensor. This allows an abnormality diagnosis of the fuel pressure sensor to be performed while avoiding the resonance phenomenon in which noticeable pulsations in fuel pressure occur. This improves the accuracy of the diagnosis.

It is noted that while FIG. 7 shows an example in which the engine rotational speed is shifted without changing the engine power, the engine power may be increased from PE2 to PE in FIG. 7 to thereby shift the engine rotational speed on fuel efficiency line F, so that the engine rotational speed falls outside the resonant range. In this case, an amount of the increased power may be charged with battery 70.

Second Embodiment

In the first embodiment, description has been given of the configuration where the target engine rotational speed is set such that the engine rotational speed, which will determine the frequency of pulsations in fuel pressure that originate from the high-pressure pump as the vibration source, falls outside the range where the resonance phenomenon tends to occur. In the second embodiment, description will be given of a configuration where the amplitude of pulsations is reduced by shifting the target fuel pressure of the feed pump to a higher fuel pressure, so as to reduce noise of the detection value from the fuel pressure sensor at resonance. It is noted that although FIGS. 1, 2 and 4 each showing the basic structure or the basic control of the stuck detection of the first embodiment is commonly applied to the second embodiment, the description thereof will not be repeated.

Figure 9:
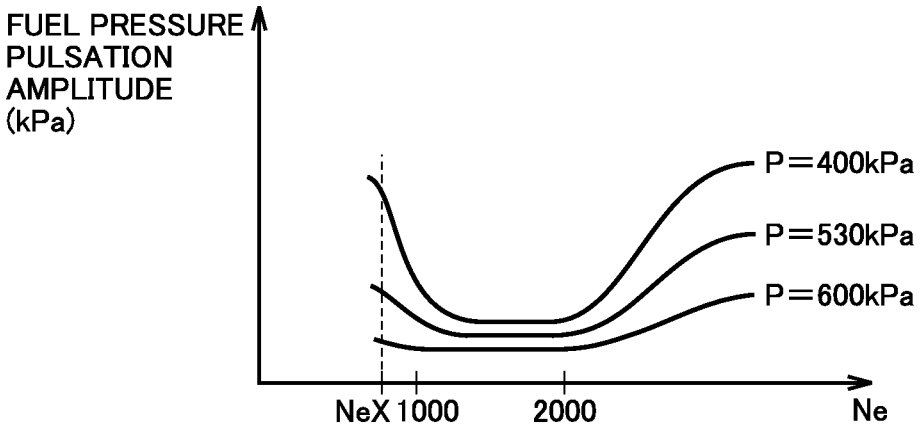
FIG. 9 is a diagram for explaining a relationship between the amplitude of fuel pressure pulsations and target fuel pressure.

FIG. 9 is a diagram for explaining a relationship between the amplitude of fuel pressure pulsations and target fuel pressure. With reference to FIG. 9, the horizontal axis represents engine rotational speed Ne and the vertical axis represents fuel pressure pulsation amplitude [kPa].

The present inventors experimentally found that when target fuel pressure P is changed to P=400 [kPa], 530 [kPa], or 600 [kPa], the amplitude of fuel pressure pulsations becomes smaller when the fuel pressure is higher at each engine rotational speed.

In particular, at the time of the stuck detection of low-pressure fuel sensor 53*a* that is performed immediately after engine start, the target engine rotational speed is typically set near an idle frequency NeX. Near idle frequency NeX, the amplitude of pulsations is significantly reduced by setting the target fuel pressure to be high.

Thus, when an abnormality diagnosis of the fuel pressure sensor is performed near idol frequency NeX, the amplitude of pulsations at resonance can be reduced by shifting the target fuel pressure of the feed pump to a higher fuel pressure.

Figure 10:
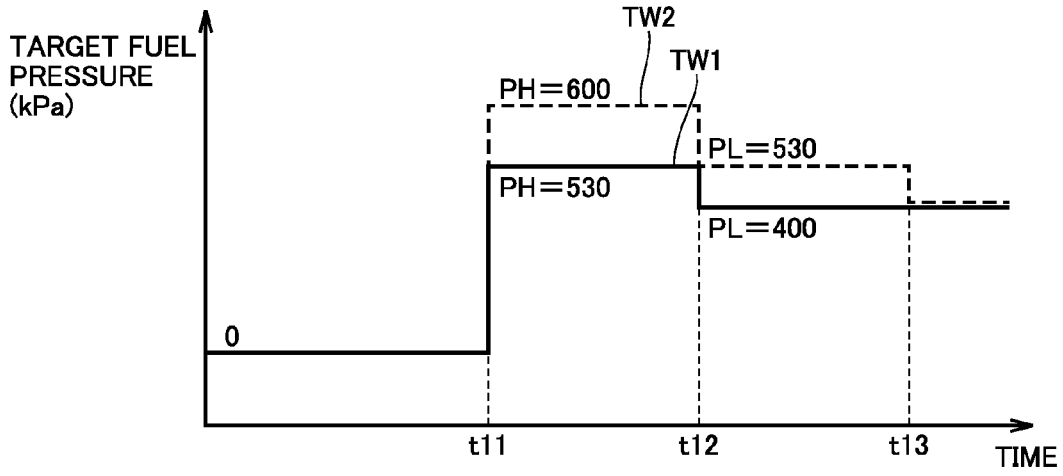
FIG. 10 is a waveform diagram for explaining how the target fuel pressure changes during the stuck detection of a fuel pressure sensor in a second embodiment.

FIG. 10 is a waveform diagram for explaining how the target fuel pressure is changed during the stuck detection of the fuel pressure sensor in the second embodiment. In FIG. 10, waveform TW1 shown by the solid line represents the case where the target fuel pressure is changed as in the stuck detection explained with FIG. 3. Waveform TW2 shown by the broken line represents the case where the target fuel pressure of the feed pump is shifted to a higher fuel pressure when an abnormality diagnosis of the fuel pressure sensor is performed near idol frequency NeX.

In the case of waveform TW1, the target fuel pressure is set to PH=530 [kPa] between times t11 and t12, and is set to PL=400 [kPa] between times t12 and t13. On the other hand, in the case of waveform TW2, the target fuel pressure is set to PH=600 [kPa] between times t11 and t12, and is set to PL=530 [kPa] between times t12 and t13. Thus, both PH and PL are set to be higher than in waveform TW1.

Figure 11:
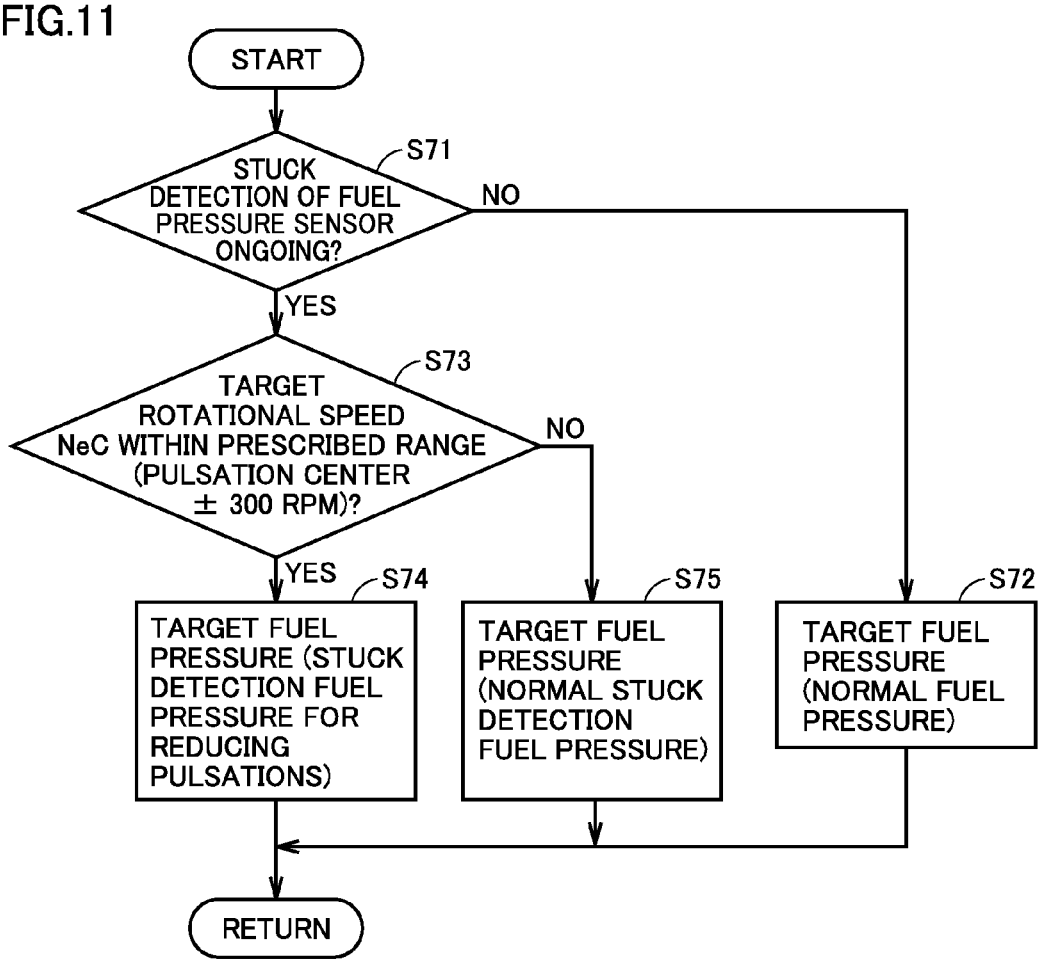
FIG. 11 is a flowchart for explaining processing to set the target fuel pressure executed in the second embodiment.

FIG. 11 is a flowchart for explaining processing to set the target fuel pressure executed in the second embodiment. With reference to FIG. 11, it is determined first in step S71 whether control device 100 is performing the stuck detection of low-pressure fuel sensor 53*a* or not. As explained with FIGS. 3 and 4, the stuck detection refers to the processing to check the detection value from low-pressure fuel sensor 53*a* by changing the target fuel pressure.

Where the stuck detection of low-pressure fuel sensor 53*a* is not ongoing in step S71 (NO in S71), the processing proceeds to step S72. In step S72, the target fuel pressure is set to a fuel pressure for normal operation (400 [kPa], for example).

Where the stuck detection of low-pressure fuel sensor 53*a* is ongoing in step S71 (YES in S71), the processing proceeds to step S73. In step S73, it is determined whether engine target rotational speed NeC is within a prescribed range (within the resonant range) or not. The prescribed range as used herein is, for example, the range of rotational speeds of ±300 rpm from an engine rotational speed corresponding to a natural frequency of the fuel pipe system (this engine rotational speed will be referred to as the "pulsation center" herein). The range, however, is not limited thereto, and may be a value experimentally determined as appropriate.

Where it is determined in step S73 that target rotational speed NeC is within the prescribed range (YES in S73), the processing proceeds to step S74 where the processing is performed to shift each of target fuel pressures PH and PL to reduce pulsations in fuel pressure at resonance. For example, when the prescribed range is pulsation center ±300 rpm, the target fuel pressure is set to fuel pressures at which pulsations decrease, that is, fuel pressures PH=600 [kPa] and PL=530 [kPa]. When the basic processing of the stuck detection shown in FIG. 4 is executed, the target fuel pressure changes as shown by broken line TW2 in FIG. 10. This decreases the amplitude of pulsations in fuel pressure in low-pressure delivery pipe 53. Thus, the detection value from low-pressure fuel sensor 53*a* stabilizes even though the engine rotational speed is within the resonant range. This leads to improvement in the accuracy of a failure diagnosis of low-pressure fuel sensor 53*a*.

It is noted that where it is determined in step S73 that target rotational speed NeC is outside the prescribed range (NO in S73), the resonance phenomenon does not occur. The processing thus proceeds to step S75 where the target fuel pressure is set to PH=530 [kPa] and PL=400 [kPa].

Once the target fuel pressure is set in any of steps S72, S74, and S75, the control is returned to the main routine.

As described above, according to the second embodiment, at the time of the stuck detection, where the engine rotational speed is within the prescribed range in which the resonance of pulsations in fuel pressure tends to occur, the fuel pressure is increased to reduce pulsations. This improves the accuracy of the detection value from the fuel pressure sensor, allowing a decrease in the possibility of an incorrect diagnosis or the like of the stuck detection.

It is noted that while hybrid vehicle 1 illustrated in FIG. 1 is a series/parallel-type hybrid vehicle, which is configured to be capable of running using at least one of engine 10 and motor generator 30 as a driving source, the present invention is also applicable to other types of hybrid vehicles.

Furthermore, while the internal combustion engine having the in-cylinder injection valves and the port injection valves is illustrated in FIG. 2, the present invention is also applicable to an internal combustion engine only with port injection valves without in-cylinder injection valves.

Moreover, the processing to change the engine rotational speed as in the first embodiment is applicable not only to a hybrid car but also to a vehicle on which a continuously variable transmission (CVT) is mounted.

Furthermore, the stuck detection processing with little influence of the resonance of pulsations according to the first and second embodiments may also be performed to check, in the presence of a failure as a result of the diagnosis by the stuck detection, that the failure is not due to an incorrect detection caused by the resonance phenomenon.

While embodiments of the present invention have been described as above, it should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

What is claimed is:

1. A control device for an internal combustion engine, said internal combustion engine comprising:

a storage section that stores fuel to be injected into an intake passage;

a feed pump that pressurizes and supplies the fuel to said storage section;

a high-pressure storage section that stores the fuel to be injected into a cylinder;

a high-pressure pump that is driven in response to rotation of said internal combustion engine, and pressurizes and supplies the fuel to said high-pressure storage section; and a fuel pressure sensor that detects a pressure of the fuel stored in said storage section, a pressure in said storage section being set to be lower than a pressure in said high-pressure storage section, and said control device is programmed to control said feed pump based on a detection value from said fuel pressure sensor, and when said control device executes an abnormality diagnosis of said fuel pressure sensor, said control device is programmed to increase a rotational speed of said internal combustion engine to be higher than a rotational speed when said control device does not execute an abnormality diagnosis of said fuel pressure sensor to avoid resonance phenomenon.

2. The control device for an internal combustion engine according to claim 1, wherein said control device is further programmed to determine a target rotational speed and a target torque of said internal combustion engine based on an operation line defined by torque, rotational speed, and power required for said internal combustion engine, and when said control device does not execute an abnormality diagnosis of said fuel pressure sensor, said control device is further programmed to control said internal combustion engine to achieve said target rotational speed and said target torque, and when said control device executes an abnormality diagnosis of said fuel pressure sensor, said control device is further programmed to control said internal combustion engine such that the rotational speed thereof becomes higher than said target rotational speed.

3. The control device for an internal combustion engine according to claim 2, wherein said feed pump is an electric pump whose rotational speed is variable based on a command from said control device, said high-pressure pump is a mechanical pump configured to be driven by a cam that rotates in response to rotation of said internal combustion engine, and said control device further programmed to reduce a pulsation component due to operation of said high-pressure pump detected in said fuel pressure sensor, by increasing the rotational speed of said internal combustion engine to be higher than said target rotational speed.

4. A control device for an internal combustion engine, said internal combustion engine comprising:

a storage section that stores fuel to be injected into an intake passage;

a feed pump that pressurizes and supplies the fuel to said storage section;

a high-pressure storage section that stores the fuel to be injected into a cylinder;

a high-pressure pump that is driven in response to rotation of said internal combustion engine, and pressurizes and supplies the fuel to said high-pressure storage section; and a fuel pressure sensor that detects a pressure of the fuel stored in said storage section, a pressure in said storage section being set to be lower than a pressure in said high-pressure storage section, and said control device is programmed to control said feed pump based on a detection value from said fuel pressure sensor, and when said control device executes an abnormality diagnosis of said fuel pressure sensor, said control device is programmed to increase a rotational speed of said internal combustion engine to be higher than a rotational speed when said control device does not execute an abnormality diagnosis of said fuel pressure sensor, said control device is further programmed to determine a target rotational speed and a target torque of said internal combustion engine based on an operation line defined by torque and rotational speed, as well as power required for said internal combustion engine, and when said control device does not execute an abnormality diagnosis of said fuel pressure sensor, said control device is further programmed to control said internal combustion engine to achieve said target rotational speed and said target torque, and when said control device executes an abnormality diagnosis of said fuel pressure sensor, said control device is further programmed to control said internal combustion engine such that the rotational speed thereof becomes higher than said target rotational speed.

5. A control device for an internal combustion engine, said internal combustion engine comprising:

a storage section that stores fuel to be injected into an intake passage; a feed pump that pressurizes and supplies the fuel to said storage section; a high-pressure storage section that stores the fuel to be injected into a cylinder; a high-pressure pump that is driven in response to rotation of said internal combustion engine, and pressurizes and supplies the fuel to said high-pressure storage section; and a fuel pressure sensor that detects a pressure of the fuel stored in said storage section, a pressure in said storage section being set to be lower than a pressure in said high-pressure storage section, and said control device is programmed to control said feed pump based on a detection value from said fuel pressure sensor, and when said control device executes an abnormality diagnosis of said fuel pressure sensor, said control device is programmed to increase a rotational speed of said internal combustion engine to be higher than a rotational speed when said control device does not execute an abnormality diagnosis of said fuel pressure sensor, said control device is further programmed to determine a target rotational speed and a target torque of said internal combustion engine based on an operation line defined by torque, rotational speed, and power required for said internal combustion engine, and when said control device does not execute an abnormality diagnosis of said fuel pressure sensor, said control device is further programmed to control said internal combustion engine to achieve said target rotational speed and said target torque, and when said control device executes an abnormality diagnosis of said fuel pressure sensor, said control device is further programmed to control said internal combustion engine such that the rotational speed thereof becomes higher than said target rotational speed.

* * * * *